US010476186B2

(12) United States Patent
Kishibata

(10) Patent No.: US 10,476,186 B2
(45) Date of Patent: Nov. 12, 2019

(54) PRESS FIT TERMINAL

(71) Applicant: Yazaki Corporation, Tokyo (JP)

(72) Inventor: Yuya Kishibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/838,212

(22) Filed: Dec. 11, 2017

(65) Prior Publication Data

US 2018/0233839 A1 Aug. 16, 2018

(30) Foreign Application Priority Data

Feb. 14, 2017 (JP) ..... 2017-024731

(51) Int. Cl.

| | |
|---|---|
| ***H01R 12/58*** | (2011.01) |
| *H01R 13/422* | (2006.01) |
| *H01R 13/428* | (2006.01) |
| *H01R 13/05* | (2006.01) |

(52) U.S. Cl.

CPC ..... *H01R 12/585* (2013.01); *H01R 13/05* (2013.01); *H01R 13/422* (2013.01); *H01R 13/428* (2013.01); *Y10S 439/943* (2013.01)

(58) Field of Classification Search

CPC .... H01R 12/585; H01R 13/05; H01R 13/422; H01R 13/428; Y10S 439/943

USPC ..... 439/82, 751, 943

See application file for complete search history.

(56) References Cited

U.S. PATENT DOCUMENTS 5,664,970 A * 9/1997 Millhimes ..... H01R 12/585 439/751

8,771,028 B2 * 7/2014 Tonosaki ..... H01R 13/03 439/151

FOREIGN PATENT DOCUMENTS

JP 2000-505590 A 5/2000

JP 2015-225701 A 12/2015

OTHER PUBLICATIONS

Japanese Office Action for the related Japanese Patent Application No. 2017-024731 dated Mar. 5, 2019.

* cited by examiner

*Primary Examiner* — Abdullah A Riyami

*Assistant Examiner* — Justin M Kratt

(74) *Attorney, Agent, or Firm* — Kenealy Vaidya LLP

(57) ABSTRACT

The present invention is to provide a press fit terminal which can suppress deterioration of the substrate when pressing and can ensure a holding force in a press-fit completion state. In elastic pieces, a portion around a top circular arc portion is formed to be thinner than a portion around a base end circular portion. Therefore, the elastic pieces can be easily deformed in the top side, and deterioration of a substrate can be prevented when pressing the press fit terminal into a through hole. Further, the elastic pieces around the base end circular portion are formed to be relatively thicker. Therefore, in the press-fit completion state, the elastic pieces can be pressed to the inner peripheral surface of the through hole with an appropriate pressure.

11 Claims, 2 Drawing Sheets

PRESS FIT TERMINAL

BACKGROUND OF THE INVENTION

Technical Field

The present invention relates to a press fit terminal pressed into a through hole of a substrate.

Related Art

In general, a press fit terminal making contact with an electrode of an inner peripheral surface of a through hole by being pressed into a through hole of a substrate is known. As such press fit terminal, a terminal having a pair of bridge portions (elastic pieces) elastically brought into contact with an inner wall of the through hole is suggested. The stiffness property of the bridge portion at a base portion side (base end side) is set to be lower than that at an insertion guide portion side (top side) (for example, see Patent Literature 1). In the press fit terminal disclosed in the Patent Literature 1, the stiffness of the base portion side is set low. For this reason, the base portion in the press fit terminal is more likely to be bent than the insertion guide portion, and the press fit terminal is less likely to move in a drop off direction for the substrate.

Patent Literature 1: JP 2015-225701 A

SUMMARY OF THE INVENTION

Objects to be Solved

However, in the press fit terminal described in Patent Literature 1, the stiffness of the top side is large. For this reason, a force to expand the through hole at the time of press-fitting becomes large, and thereby there is possibility of damaging the substrate. The damaged substrate may deteriorate insulation due to whitening. Meanwhile, in order to reduce damage to the substrate, when the stiffness of the whole press fit terminal is decreased, the holding force is decreased, and the press fit terminal is possibly moved with respect to the substrate in a state pressed into the through hole to a normal depth (press-fit completion state).

An object of the present invention is to provide a press fit terminal which makes it difficult to deteriorate the substrate when press-fitting and can maintain holding force in a press-fit completion state.

In order to solve and achieve the object, the present invention is a press fit terminal including a press fitting portion to be pressed into a through hole of a substrate and to contact with an electrode of an inner peripheral surface of the through hole. The press fitting portion includes a through bore extending along a press-fitting direction and penetrating in a direction along a surface of the substrate, and a pair of elastic pieces having an inner edge portion and an outer edge portion and sandwiching the through bore therebetween, the inner edge portion and the outer edge portion having a convex curved surface shaped outward, the through bore has a top circular arc portion and a base end circular arc portion, and is formed in an oval shape extending along the press-fitting direction, and in the elastic pieces a circumference around the top circular arc portion are formed to be thinner than a circumference around the base end circular arc portion.

In the present invention, the elastic pieces have a center pressure contact portion to be overlapped with the outer edge portion when moving in parallel to the inner edge portion.

Further, in the present invention, a center of the base end circular arc portion is located closer to a maximum breadth of the press fitting portion in the press-fitting direction than a center of the top circular arc portion, the base end circular arc portion is larger than the top circular arc portion in curvature radius, and in the through bore a top side is spaced farther than a base end side based on the maximum breadth.

Furthermore, in the present invention, in the outer edge portion a top side and a base end side are formed with a plane symmetry when a surface passing the maximum breadth of the press fitting portion is viewed as a symmetry plane.

Moreover, in the present invention, the outer edge portion is formed in an outwardly convex shaped when viewing from the press-fitting direction.

According to the present invention, in the elastic pieces, the circumferences around the top circular arc portion are formed to be thinner than a circumference around the base end circular arc portion. Therefore, the elastic piece at the top side is easily elastically deformed, and deterioration of the substrate can be prevented when pressed into the through hole. Further, since the circumference around the base end circular arc portion in the elastic piece is formed to be relatively thin, in press-fit completion state the elastic pieces can be pressed and contact into the inner peripheral surface of the through hole with an appropriate pressure, and the holding force can be maintained.

Further, since the elastic pieces include the inner edge portion and the outer edge portion having an outwardly convex curved surface, in the elastic pieces the convex shaped portion pressing to the inner peripheral surface of the through hole is deformed such that it becomes flat in conformity to the inner peripheral surface. Therefore, the pressure on the substrate when pressing is gradually increased according to pressing, and it is largest when the maximum breadth of the press fitting portion is pressed. On the other hand, the elastic pieces have an outwardly convex curved surface portion formed in the top side and the base end side, and a flat portion between the curved surface portions. When the flat portion is pressed, the flat portion itself is not deformed, and the curved surface portion is deformed. At this time, the pressure on substrate during pressing is gradually increased until a boundary portion between the curved surface portion of the top side and the flat portion is pressed. However, while the flat portion is pressed, the pressure is hardly changed. Therefore, in the present invention, the whole of the outer edge portion of the elastic piece have the curved surface shape, and thereby the substrate can be prevented from deteriorating when pressing it.

According to the present invention, the center pressure contact portion is overlapped with the outer edge portion when parallely moving the inner edge portion outward. Therefore, the thickness of the center pressure contact portion can be approximately constant. Thereby, in the center pressure contact portion, a portion of which the intensity is low is hardly formed, and local deformation when pressing can be difficult to occur. When the amount of a misalignment between the center of the through hole and the center of the press fit terminal and an inclination angle of the press fit terminal for the through hole are increased (that is, insertion conditions get worse), deformation when pressing is easily occurred. However, since the thickness of the center pressure contact portion is approximately constant in present invention, local deformation is less likely to occur.

As a result, tolerance for insertion conditions (misalignment amount or inclination angle) into the through hole can be improved.

According to the present invention, a distance from the maximum breadth to the top side is larger than a distance from the maximum breadth to the base end side. For this reason, the length from the maximum breadth to the base end side is shorter than the length from the maximum breadth to the top side in the elastic pieces. Therefore, the top side in the elastic pieces is easily deformed, and the base end side is hardly deformed. Further, the deterioration of the substrate can be prevented when pressing, and holding force can be maintained in a press-fit completion state. Moreover, the curvature radius of the base end circular arc portion is larger than that of the top circular arc portion. Therefore, even if the center of the base end circular arc portion is brought closer to the maximum breadth than the center of the top circular arc portion, the inner edge portions of the pair of the elastic pieces can be smoothly connected each other.

According to the present invention, the edge portion is formed with a plane symmetry. Therefore, by adjusting the shape of the through bore having the inner edge portion, the top circular arc portion, and the base end circular arc portion, the elastic piece of an appropriate shape is obtained. That is, the shape of the through bore is decided such that the press fitting portion has a desired pressure characteristic, and the through bore having such shape only has to be formed. Thus, the press fit terminal, which is able to suppress deterioration of the substrate when pressing and to maintain holding force in a press-fit completion state, can be easily manufactured.

According to the present invention, the outer edge portion is formed in a convex shaped outward viewing from the press-fitting direction. Therefore, the outer edge portion is likely to contact with the inner peripheral surface of the through hole, contact area between the elastic piece and the inner peripheral surface is increased, and holding force in the press-fit completion state can be increased.

DESCRIPTION OF THE PREFERRED EMBODIMENT

Figure 1:
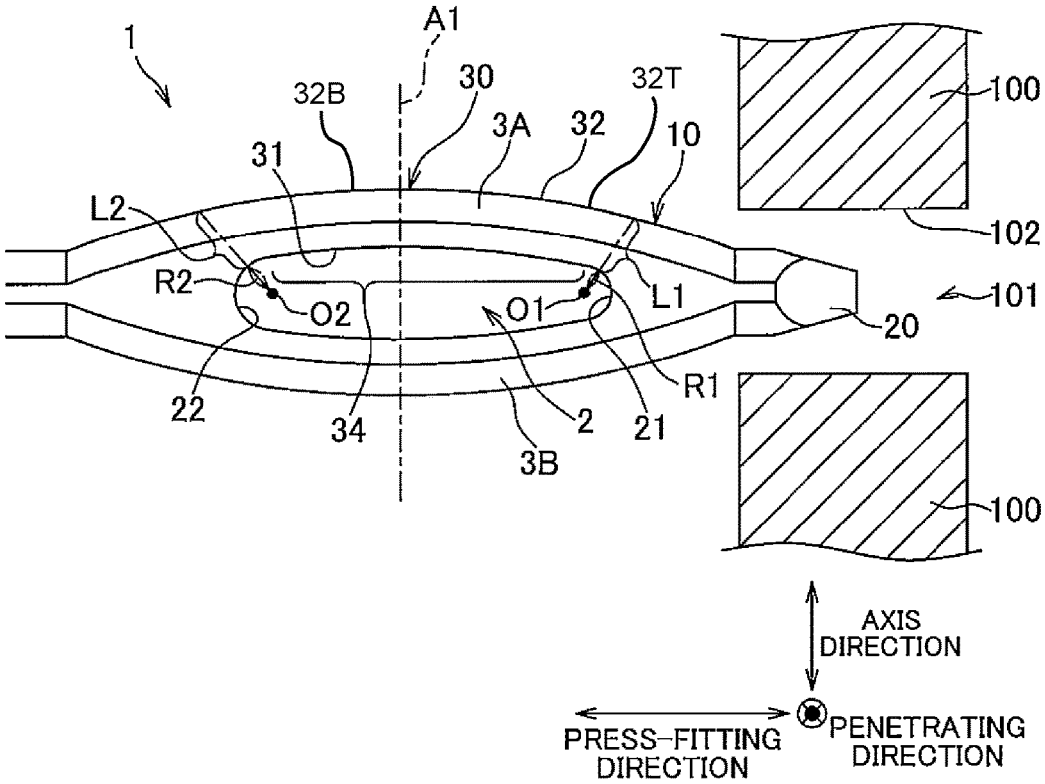
FIG. 1 is a side view showing a press fit terminal according to an embodiment of the present invention.
Figure 2:
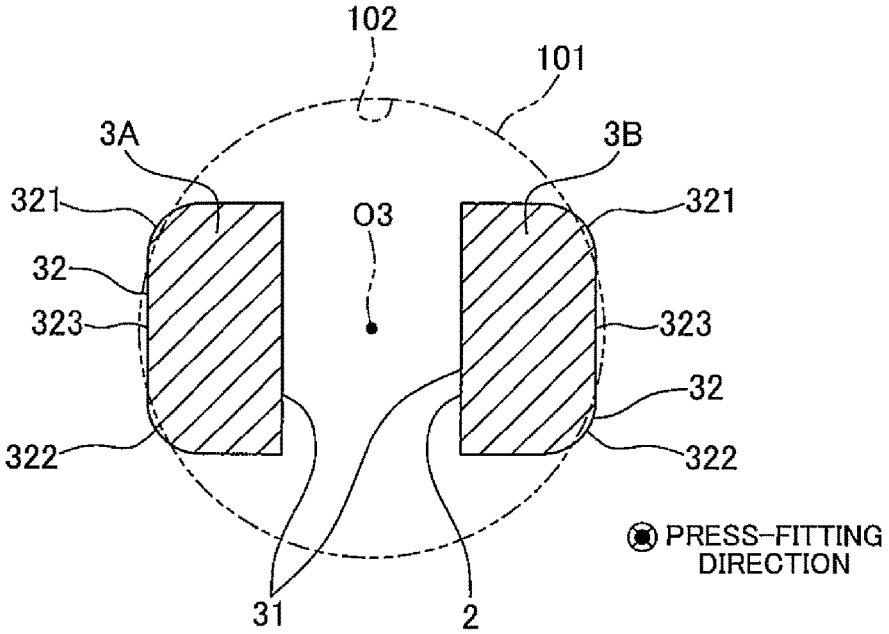
FIG. 2 is a cross-sectional view seeing the press fit terminal from a press-fitting direction.

Hereinafter, an embodiment of the present invention will be described with reference to drawings. FIG. 1 is a side view showing a press fit terminal 1 according to the embodiment of the present invention. FIG. 2 is a cross-sectional view seeing the press fit terminal 1 from a press-fitting direction.

As shown in FIG. 1, the press fit terminal of the embodiment in the present invention is pressed into a through hole 101 of a substrate 100, and thereby makes contact with an electrode of an inner peripheral surface 102 in the through hole 101. The press fit terminal is made of conducting material such as copper alloy, and formed into a bar shape of which the whole extends in a press-fitting direction (vertical direction of the substrate 100). In a surface of the press fit terminal 1, tin series plating with nickel base, silver plating or gold plating may be covered. The substrate 100 is a printed board in which circuit sections and a through hole are formed in an insulating substrate body. The press fit terminal is for example arranged in a circuit component. The circuit component is connected to the circuit section of the substrate 100 by pressing the press fit terminal 1 into the through hole 101.

The press fit terminal 1 includes a press fitting portion 10 pressed into the through hole 101, and a tip portion 20 tapered toward a top side from the press fitting portion 10. The press fitting portion 10 includes a through bore 2 penetrating in a direction along a surface (top surface or bottom surface) of the substrate 100, and a pair of elastic pieces 3A and 3B sandwiching the through bore 2 between them. Further, the press fitting portion 10 has a portion whose width is larger than an inner diameter of the through hole 101.

The through bore 2 is formed in a slotted hole shape extending in the press-fitting direction. Further, the through bore 2 is configured by connecting a top circular arc portion 21 formed in the top side, a base end circular arc portion 22 formed in a base end side, and an inner edge portion 31 of the elastic pieces 3A and 3B described below. Also, the shape of the through bore 2 is approximately constant in each position of a penetrating direction.

The center O2 of the base end circular arc portion 22 is positioned closer to a surface (a center passing surface) A1 passing through a maximum breadth 30 of the press fitting portion 10 and perpendicular to the press-fitting direction than the center O1 of the top circular arc portion 21. That is, the center O2 is located near the maximum breadth 30 in the press-fitting direction. Further, the maximum breadth 30 is a portion of which a dimension of the press fitting portion 10 in a width direction (a direction in which the pair of elastic pieces 3A and 3B are faced) is a maximum. Furthermore, a distance between the center O2 of the base end circular arc portion 22 and the center passing surface A1 is set to half of the substrate 100 in thickness. In other words, when the maximum breadth 30 is positioned in the center of the substrate 100 in a substrate thickness direction, the center O2 of the base end circular arc portion 22 is located on the same plane as the surface of the substrate 100. At this time, the center O1 of the top circular arc portion 21 is positioned in a place projecting toward an outside of the substrate 100. Therefore, a dimension of the through bore 2 in the press-fitting direction is larger than the thickness of the substrate 100.

The base end circular arc portion 22 is larger than the top circular arc portion 21 in a curvature radius. That is, a radius R2 of the base end circular arc portion 22 is larger than a radius R1 of the top circular arc portion 21. In the through bore 2, a distance from the maximum breadth 30 to a top side is larger than a distance from the maximum breadth 30 to a base end side.

The elastic pieces 3A and 3B respectively include an inner edge portion 31 curved outward and an outer edge portion 32 curved outward, and have a symmetrical shape each other. The inner edge portion 31 and the outer edge portion 32 are entirely curved, and do not have a planer portion. Further, a top curved outward in the inner edge portion 31 and a top curved outward in the outer edge portion 32 are nearly matched up in the press-fitting direction, and a portion including those tops becomes the maximum breadth 30. Also, since the outer edge portion 32 has arc-shaped corners 321 and 322 viewing from the press-fitting direction as described below, shapes at each of positions in a penetrating direction are not constant. The shape of the outer edge portion 32 explained below shows a shape of a center portion (a portion corresponding to a flat portion 323 described below) in the penetrating direction except as otherwise noted.

In the outer edge portion 32, a top side 32T and a base end side 32B are face-symmetrically formed such that the center passing surface A1 becomes a symmetric face. On the other hand, in the inner edge portion 31, the center O2 is positioned closer to the surface A1 than the center O1 as described above. Therefore, the length is different between the top side and the base end side. That is, the length from the maximum breadth 30 to the base end side in the elastic pieces 3A and 3B is shorter than the length from the maximum breadth 30 to the top side.

The inner edge portion 31 and the outer edge portion 32 are a part of the oval shape such as an ellipse, and the inner edge portion 31 overlaps with a part of the outer edge portion 32 by parallel moving the inner edge portion 31 outward in a width direction. In the elastic pieces 3A and 3B, a portion in which the inner edge portion 31 overlaps with the outer edge portion 32 is a center pressure contact portion 34.

As shown in FIG. 2, the elastic pieces 3A and 3B are formed in a rectangular shape viewing from the press-fitting direction, and the outer edger portion 32 includes circular arc shaped corners 321 and 322, and a flat portion 323 between the corners 321 and 322. It is preferred that a curvature radius of each of the corners 321 and 322 is large, and the center of the circular arc of the corners 321 and 322 is close to a center O3 of the through hole 101. Since two corners 321 and 322 are extended approach to each other, the whole of the outer edge portion 32 is formed in a convex shape outward viewing from the press-fitting direction.

In an example of drawings, in the maximum breadth 30, a length of a diagonal line connecting the corner 321 of the elastic piece 3A and the corner 322 of the elastic piece 3B (equal to a length of a diagonal line connecting the corner 321 of the elastic piece 3B and the corner 322 of the elastic piece 3A) is larger than the inner diameter of the through hole 101, and a length connecting the flat portion 323 of the elastic piece 3A and the flat portion 323 of the elastic piece 3B is smaller than the inner diameter of the through hole 101. That is, mainly the corners 321 and 322 in the elastic pieces 3A and 3B are pressed against the inner peripheral surface 102 of the through hole 101.

Moreover, when the curvature radii of the corners 321 and 322 can be made sufficiently large, the corners 321 and 322 may be continuously formed without forming the flat portion 323. That is, the whole of the outer edge portion 32 may be pressed along the inner peripheral surface 102 of the through hole 101.

Hereinafter, the thicknesses of the elastic pieces 3A and 3B will be explained. The "thicknesses of the elastic pieces 3A and 3B" in the center pressure contact portion 34 is a space between portions corresponding to the inner edge portion 31 and the outer edge portion 32. Further, the "thicknesses of the elastic pieces 3A and 3B" around the circular arc portions 21 and 22 is a length of a portion passing the elastic pieces 3A and 3B among an extension line extending from the centers O1 and O2 in a radial direction. Furthermore, thick portions of the elastic pieces 3A and 3B are referred to as "thick", while thin portions thereof are referred to as "thin".

In the elastic pieces 3A and 3B, the thickness of the center pressure contact portion 34 are approximately constant, and the thicknesses around the top circular arc portion 21 and the base end circular arc portion 22 are thicker than that of the center pressure contact portion 34. Further, the thickness around the top circular arc portion 21 is formed to be thinner than that around the base end circular arc portion 22. More specifically, as an example shown in drawings, in a case that a length passing the elastic piece 3A or 3B in an extension line extending in the radial direction from the center O1 to be inclined at an equal angle with respect to the width direction is L1, and a length passing the elastic piece 3A or 3B in an extension line extending in the radial direction from the center O2 to be inclined at an equal angle with respect to the width direction is L2, the length L1 at the top side is shorter than the length L2 at the base end side.

When the press fit terminal 1 as described above is pressed into the through hole 101, the press fitting portion 10 has a portion in which a width is larger than the inner diameter of the through hole 101. Therefore, the outer edge portions of the elastic pieces 3A and 3B come in contact with the inner peripheral surface 102 of the through hole 101, and elastically deform so that the elastic pieces 3A and 3B approach each other (so that the width of the through bore 2 becomes small). At this time, the elastic pieces 3A and 3B come in contact with the inner peripheral surface 102 in mainly the center pressure contact portion 34, and the touched convex portion is likely to be deformed flat in conformity to the inner peripheral surface 102.

A pressure on the substrate 100 when pressing the press fitting portion 10 gradually increases until the elastic pieces 3A and 3B come into contact with the inner peripheral surface 102 and then the center pressure contact portions 34 contact each other. After the center pressure contact portions 34 contact each other, the pressure on the substrate 100 is approximately constant.

A pressing amount (pressing depth) of the press fit terminal 1 to the through hole 101 is controlled by regulating a projecting amount of the press fit terminal 1 from the substrate 100 in the top side or base end side by using for example a jig, so that it becomes a predetermined amount.

According to the embodiment of the present invention, there are effects as below. More specifically, the elastic pieces 3A and 3B are formed so that the elastic pieces 3A and 3B around the top circular arc portion 21 is thinner than the elastic pieces 3A and 3B around the base end circular arc portion 22 in thickness. Therefore, the elastic pieces 3A and 3B can be easily elastically deformed on the top side, and deterioration of the substrate 100 when pressing the press fit terminal into the through hole 101 can be prevented. Further, since the elastic pieces 3A and 3B around the base end circular arc portion 22 are formed with relatively thick, the elastic pieces 3A and 3B can be pressed into the inner peripheral surface 102 of the through hole 101 at an appropriate pressure and holding force can be maintained in a press-fit completion state.

Further, the elastic pieces 3A and 3B has the inner edge portion 31 outward curved and the outer edge portion 32 outward curved. Therefore, a pressure on the substrate during pressing is gradually increased with pressing, and the pressure is a maximum when the maximum breadth 30 is inserted. Meanwhile, the elastic pieces are configured with a convex curved surface portion outward formed in the top side and the base end side and a flat portion between the curved surface portions. When the flat portion is pressed, the flat portion itself is not deformed, and the curved surface portion is deformed. At this time, the pressure on substrate during pressing is gradually increased until a boundary portion between the curved surface portion of the top side and the flat portion is pressed. However, while the flat portion is pressed, the pressure is hardly changed. That is, the pressure applied at the initial press-fit rises rapidly. Therefore, in the press fit terminal 1 of the embodiment in the present invention, the whole of each of the outer edge portions 32 of the elastic pieces 3A and 3B have the curved surface shape, and thereby the substrate 100 can be prevented from deteriorating when pressing it.

Further, the center pressure contact portion 34 is overlapped with the outer edge portion 32 when parallely moving the inner edge portion 31 outward. Therefore, the thickness of the center pressure contact portion 34 can be approximately constant. Thereby, in the center pressure contact portion 34, a portion of which the intensity is low is hardly formed, and local deformation when pressing can be difficult to occur. When the amount of a misalignment between the center of the through hole 101 and the center of the press fit terminal 1 and an inclination angle of the press fit terminal 1 for the through hole 101 are increased (that is, insertion conditions get worse), deformation when pressing is easily occurred. However, since the thickness of the center pressure contact portion 34 is approximately constant in present invention, local deformation is less likely to occur. As a result, tolerance for insertion conditions (misalignment amount or inclination angle) into the through hole 101 can be improved.

Further, in the through bore 2 a distance from the maximum breadth 30 to the top side is longer than a distance from the maximum breadth 30 to the base end side. For this reason, in the elastic pieces 3A and 3B the length from the maximum breadth 30 to the base end side is shorter than the length from the maximum breadth 30 to the top side. Therefore, in the elastic pieces 3A and 3B the top side is easily deformed and the base end side is hardly deformed. Furthermore, when pressing, the substrate 100 is hardly deteriorated, and holding force can be maintained in a press-fit completion state. Moreover, the curvature radius of the base end circular arc portion 22 is larger than that of the top circular arc portion 21. Therefore, even if the center O2 of the base end circular arc portion 22 is brought closer to the maximum breadth 30 than the center O1 of the top circular arc portion 21, the inner edge portions 31 of the pair of the elastic pieces 3A and 3B are smoothly connected to each other.

Further, the outer edge portion 32 is formed plane-symmetrically with the center passing surface A1 as a plane of symmetry. Therefore, by regulating the shape of the through bore 2 having the inner edge portion 31, the top circular arc portion 21 and the base end circular arc portion 22, the elastic pieces 3A and 3B having an appropriate shape can be obtained. In other words, the shape of the through bore 2 is decided so that the press fitting portion 10 has a desired pressure characteristic. The present invention only has to form the through bore 2 having such shape, and can easily manufacture the press fit terminal 1 which can prevent deterioration of the substrate 100 when pressing and maintain holding force in a press-fit completion state.

Further, since the outer edge portion 32 is formed in the convex shaped outward seeing from the press-fitting direction, the outer edge portion 32 is likely to contact with the inner peripheral surface 102 of the through hole 101, contact area between the elastic pieces 3A and 3B and the inner peripheral surface 102 is increased, and holding force in a press-fit completion state can be increased.

Also, the present invention is not limited to the above embodiments. The present invention includes various constitutions in which the object of the present invention can be achieved, and the following modifications are includes in the present invention.

For example, in the press fit terminal 1 in the above embodiment of the present invention, the center pressure contact portion 34 is formed such that the inner edge portion 31 is overlapped with the outer edge portion 32 when the inner edge portion 31 is moved in parallel, the center O2 of the base end circular arc portion 22 is located closer to the center passing surface A1 than the center of the top circular arc portion 21, and the curvature radius of the base end circular arc portion 22 is larger than that of the top circular arc portion 21. However, it is not limited thereto, and the elastic piece around the top circular arc portion just has to be formed to be thinner than that around the base end circular arc portion. For example, the inner edge portion may have another shape.

Figure 3:
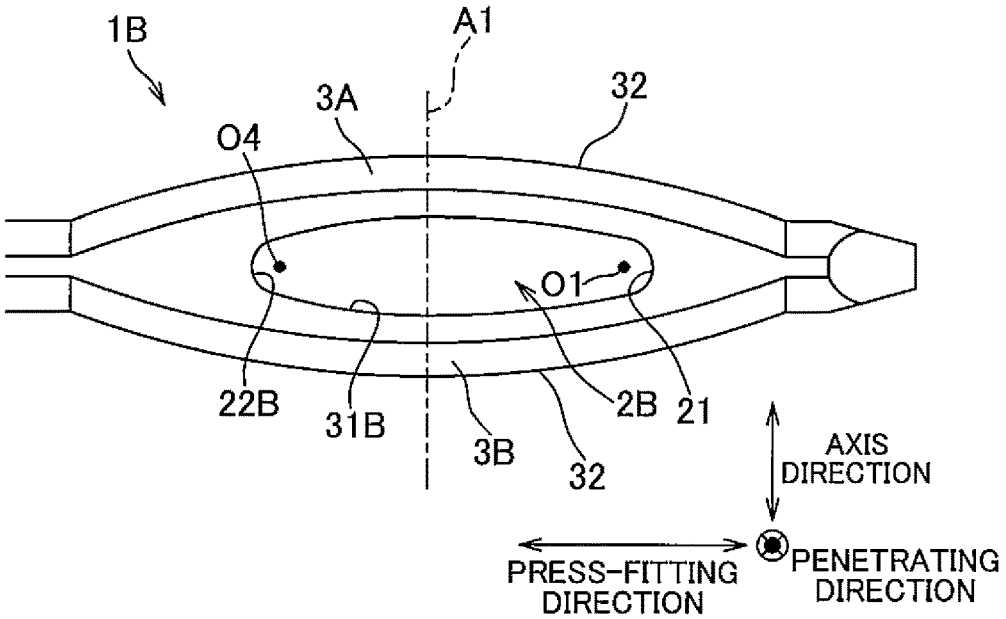
FIG. 3 is a cross-sectional view showing the press fit terminal according to a first modified example of the present invention.

In a press fit terminal 1B of a first modified example shown in FIG. 3, a through bore 2B has the top circular arc portion 21 and the base end circular arc portion 22 having the curvature radius smaller than the top circular arc portion 21. In this case, a center O4 of a base end circular arc portion 22B is located closer to the center passing surface A1 than the center O1 of the top circular arc portion 21. Furthermore, the inner edge portion 31B is formed with a curved surface at the base end side than the center passing surface A1 such that the inner edge portion 31B is not overlapped with the outer edge portion 32 even if the inner edge portion 31B is moved in parallel. Thereby, the inner edge portion 31B is smoothly connected to the base end circular arc portion 22B, and the thickness around the top circular arc portion 21 is thinner than that around the base end circular arc portion 22B.

Figure 4:
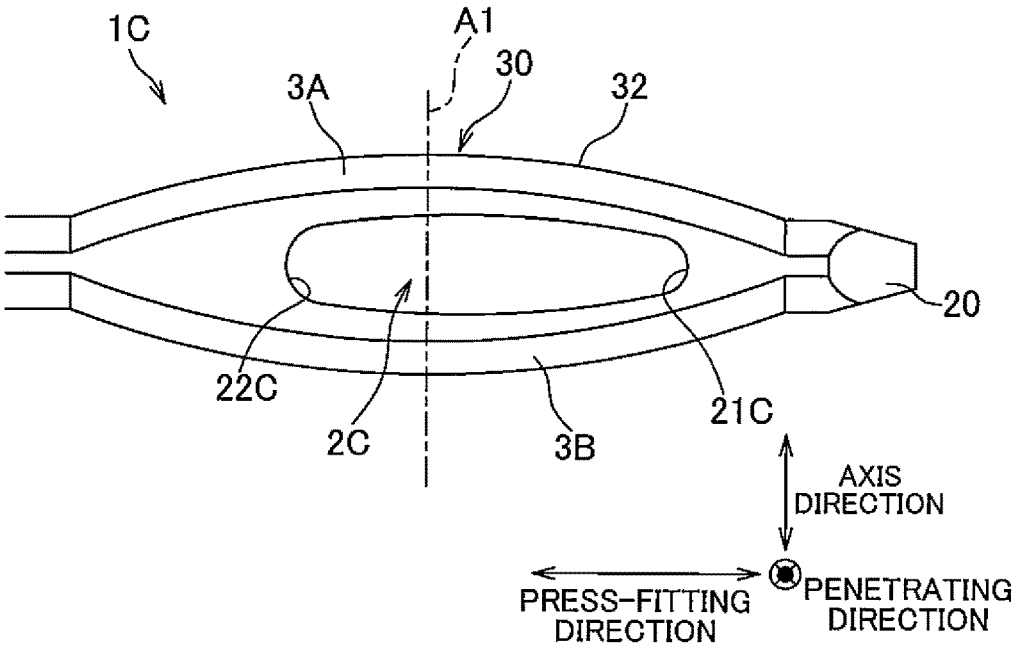
FIG. 4 is a cross-section view showing the press fit terminal according to a second modified example of the present invention.

In the press fit terminal 1C of a second modified example shown in FIG. 4, the whole of the inner edge portion 2C is formed with a curved surface such that the inner edge portion 2C is not overlapped with the outer edge portion 32 even if the inner edge portion 2C is moved in parallel. In this case, the width of the through bore 2C is the largest at the top side than the maximum breadth 30 (that is, the through bore 2C is formed with an oval shape offset to the top side when the center passing surface A1 is used as a reference). Therefore, the thickness around the top circular arc portion 21C is thinner than that around the base end circular arc portion 22C.

Further, in the above embodiment, the outer edge portion 32 is formed with a plane symmetry so that the center passing surface A1 becomes a symmetric face, but the outer edge portion may not be formed with a plane symmetry. For example, the edge portion may have a shape sharply tapered from the maximum breadth toward the top side than from the maximum breadth toward the base end side. Thereby, the thickness around the top circular arc portion may be thinner than that around the base end circular arc portion.

Further, in the above embodiment, the edge portion 32 has the arc-like corners 321 and 322, and thereby the whole of the outer edge portion 32 is formed in the convex shape outward viewing from the press-fitting direction, however it is not limited thereto. A portion in the outer edge portion opposed to the inner peripheral surface 102 of the through hole 101 is formed with an arc-like shape, and thereby the whole of the outer edge portion may be formed with a convex shape outward viewing from the press-fitting direction. Furthermore, when the elastic pieces is easily compressive deformed in conformity to the inner peripheral surface 102 of the through hole 101, and contact area can be ensured, the outer edge portion may be not formed with the convex shape outward viewing from the press-fitting direction (that is, it may be formed with a flat shape).

The best mode configurations, methods and the like for carrying out the present invention are disclosed in the above description, but the present invention is not limited thereto. In the other words, the present invention is illustrated with reference to a specific embodiment, and explained. However, various modifications can be made by those skilled in the art to the above-described embodiments, in shapes, materials, quantities, and other detailed configurations without departing from the technical idea and the scope of the object of the present invention. Thus, descriptions that restrict the shape, material, etc. disclosed above are exemplarily described in order to facilitate understanding of the present invention, and the present invention is not limited thereto. So, descriptions in the name of members excluding a part of the limitation of the shape, material, etc. or all of the limitation are included within the scope of the present invention.

REFERENCE SIGNS LIST

1 press fit terminal
2 through bore
21 top circular arc portion
22 base end circular arc portion
3A, 3B elastic piece
30 maximum breadth
31 inner edge portion
32 outer edge portion
34 center pressure contact portion
10 press fitting portion
O1 center of top circular arc portion
O2 center of base end circular arc portion
A1 center passing surface (surface passing maximum breadth)
100 substrate
101 through hole
102 inner peripheral surface

The invention claimed is:

1. A press fit terminal comprising:

a press fitting portion to be pressed into a through hole of a substrate and to contact with an electrode of an inner peripheral surface of the through hole, wherein the press fitting portion includes a through bore extending along a press-fitting direction and penetrating in a direction along a surface of the substrate, and a pair of elastic pieces, each of the elastic pieces having an inner edge portion and an outer edge portion, the elastic pieces sandwiching the through bore therebetween, and each of the inner edge portions and each of the outer edge portions having an outwardly convexed curved surface, the through bore has a top circular arc portion and a base end circular arc portion, and is formed in an oval shape extending along the press-fitting direction, and a portion of each of the elastic pieces that is adjacent to the top circular arc portion is formed to be thinner than a portion of each of the elastic pieces that is adjacent to the base end circular arc portion, wherein the elastic pieces have a center pressure contact portion where a curve representing the inner edge portion overlaps the outer edge portion if the curve representing the inner edge portion is superimposed on the outer edge portion.

2. The press fit terminal according to claim 1, wherein the outer edge portion is formed in a convex shaped outward viewing from the press-fitting direction.

3. The press fit terminal according to claim 1, wherein each of the inner edge portions extends from the top circular arc portion and the base end circular arc portion, and each of the inner edge portions follows a curve that is continuous from the top circular arc portion to the based end circular arc portion.

4. The press fit terminal according to claim 1, wherein a center of the base end circular arc portion is located closer to a maximum breadth of the press fitting portion in the press-fitting direction than a center of the top circular arc portion, the base end circular arc portion is larger than the top circular arc portion in curvature radius, and in the through bore a top side is spaced farther from the maximum breadth in the press fitting direction than is a base end side.

5. The press fit terminal according to claim 4, wherein in the outer edge portion a top side and a base end side are formed with a plane symmetry when a surface passing the maximum breadth of the press fitting portion is viewed as a symmetry plane.

6. The press fit terminal according to claim 5, wherein the outer edge portion is formed in a convex shaped outward viewing from the press-fitting direction.

7. The press fit terminal according to claim 4, wherein the outer edge portion is formed in a convex shaped outward viewing from the press-fitting direction.

8. The press fit terminal according to claim 1, wherein in the outer edge portion a top side and a base end side are formed with a plane symmetry when a surface passing the maximum breadth of the press fitting portion is viewed as a symmetry plane.

9. The press fit terminal according to claim 8, wherein the outer edge portion is formed in a convex shaped outward viewing from the press-fitting direction.

10. A press fit terminal comprising:

a press fitting portion to be pressed into a through hole of a substrate and to contact with an electrode of an inner peripheral surface of the through hole, wherein the press fitting portion includes a through bore extending along a press-fitting direction and penetrating in a direction along a surface of the substrate, and a pair of elastic pieces, each of the elastic pieces having an inner edge portion and an outer edge portion, the elastic pieces sandwiching the through bore therebetween, and each of the inner edge portions and each of the outer edge portions having a convex curved surface shaped outward, the through bore has a top circular arc portion and a base end circular arc portion, and is formed in an oval shape extending along the press-fitting direction, and a portion of each of the elastic pieces that is adjacent to the top circular arc portion is formed to be thinner than a portion of each of the elastic pieces that is adjacent to the base end circular arc portion, wherein in the outer edge portion a top side and a base end side are formed with a plane symmetry when a surface passing the maximum breadth of the press fitting portion is viewed as a symmetry plane.

11. The press fit terminal according to claim 10, wherein the outer edge portion is formed in a convex shaped outward viewing from the press-fitting direction.

* * * * *